United States Patent [19]

Benson et al.

[11] 4,009,459

[45] Feb. 22, 1977

[54] RESIN-EMPOTTED DRY-TYPE ELECTROMAGNET FOR DUSTY AND GASSEY LOCATIONS

[76] Inventors: William H. Benson, 2421 Plum St., Erie, Pa. 16501; Gerald D. Rose, 2676 Hazel St., Erie, Pa. 16508

[22] Filed: May 5, 1975

[21] Appl. No.: 574,803

[52] U.S. Cl. ..... 335/300; 336/61; 336/96

[51] Int. Cl.[2] ..... H01F 5/00; H01F 27/08

[58] Field of Search ..... 335/300, 299, 217, 292; 336/55, 61, 96; 174/16 HS, 52 PE

[56] References Cited

UNITED STATES PATENTS

| | | | |
|---|---|---|---|
| 2,882,505 | 4/1959 | Feder | 336/96 |
| 3,238,489 | 3/1966 | Hay | 174/16 HS |
| 3,283,278 | 11/1966 | Palm | 335/292 |
| 3,467,929 | 9/1969 | Derbyshire et al. | 336/61 |

*Primary Examiner*—Harold Broome

[57] ABSTRACT

An electromagnet is disclosed. The electromagnet has a winding that is wet wound with an epoxy material filled with grains of a material having a high coefficient of thermal-conductivity. The entire winding is empotted dry in a similar epoxy having grains of the said material. Fins are connected to the outside of the dry empotment for carrying away heat transferred to the fins from the coil.

3 Claims, 3 Drawing Figures

RESIN-EMPOTTED DRY-TYPE ELECTROMAGNET FOR DUSTY AND GASSEY LOCATIONS

GENERAL STATEMENT OF THE INVENTION

A large separation type electromagnet which is entirely air cooled by normal convection is disclosed. The heat energy developed by the magnetic winding is transferred to the external convecting surfaces by a resin filled with high thermalconduction material. The coil is wet wound with the empotting material. The said resin is heat cured to a solid, dry mass having heat transfer characteristics of the order of ten BTU/in. per square foot per hour ° F. Previous magnet designs have commonly been cooled by circulating dielectric fluid, such as mineral oil or askarel, or by heat conduction through the dry-wound unpotted winding to the external convecting surfaces. The type of coil cooled by dielectric fluid suffers the major disadvantages of being complex due to the necessity of providing means for circulation of the fluid and for its expansion upon being heated; while the dry wound unpotted types suffer the major disadvantages of being bulky, expensive, and inefficient due to the necessity of providing a coil with low wattage in order to minimize the internal hot-spot temperatures.

Further, with the fluid-cooled type, it is extremely difficult to make the system explosion proof for hazardous gassy atmospheres in accord with modern-day standards for such equipment. The fluid that is used must be the non-flammable askarel, a material that has recently been found to be so dangerous to the environment in the event of leaks that it is now being phased out as a coolant in fluid-cooled systems.

With the dry-wound unpotted type it is extremely difficult to make the unit dust-tight for hazardous dusty atmospheres and still retain the ncessary heat transfer to the outside convecting surfaces.

The invention disclosed herein makes it possible to design a large explosion-proof, dust-tight magnet coil with coil depth as great as 16 inches, while still operating at normal wattage and with a coil of moderate size for the magnetomotive force to be developed. Coils according to previous designs were impractical above a maximum depth of 6 inches for a dry wound unpotted coil operating at a normal wattage level.

Other featues of the invention which enhance the operation of the coil are the solid welds that join the magnet back bars, the corner fins, the bottom plate and the shell and the core. Heat transfer from the coil hot spots to the fins is through the resin-saturated coil and the surrounding resin which is potted between the outside of the saturated winding and the shell. The steel shell is made cylindrical in form in order to better withstand the effects of internal explosions as well as to provide short conduction paths to the shell. The cylindrical shape of the shell also saves potting material. The steel corner support fins serve several purposes. (1) provide additional exterior convecting surfaces, (2) support the wear plate, (3) provide additional shell support at the four corners, (4) improve the appearance of the electromagnet, and (5) provide a supporting means for auxiliary hardware.

OBJECTS OF THE INVENTION

It is an object of the invention to provide an improved electromagnet.

Another object of the invention is to provide an electromagnet with high heat dissipation characteristics.

Another object of the invention is to provide an improved electromagnet that is simple in construction, economical to manufacture and simple and efficient to use.

With the above and other objects in view, the present invention consists of the combination and arrangement of parts hereinafter more fully described, illustrated in the accompanying drawings and more particularly pointed out in the appended claims, it being understood that changes may be made in the form, size, proportions, and minor details of construction without departing from the spirit or sacrificing any of the advantages of the invention.

GENERAL DESCRIPTION OF DRAWINGS

DETAILED DESCRIPTION OF THE DRAWINGS

Figure 1:
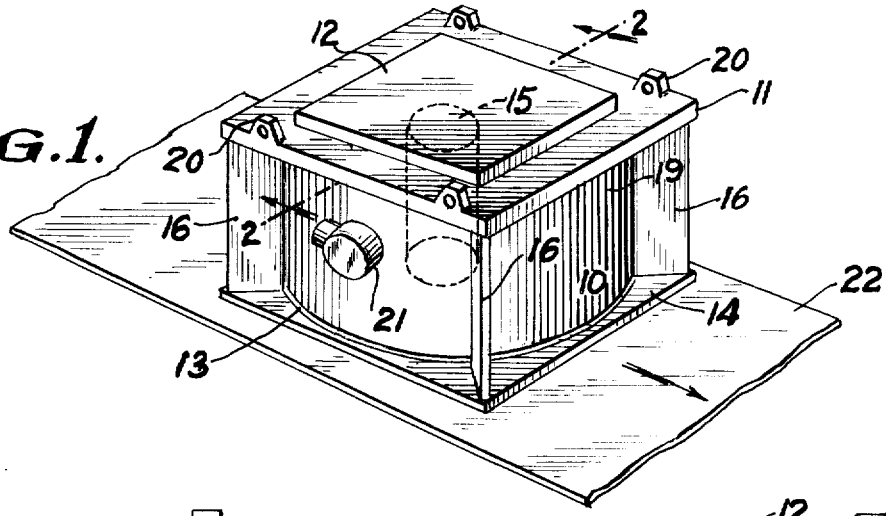
FIG. 1 is an isometric view of the electromagnet according to the invention.
Figure 2:
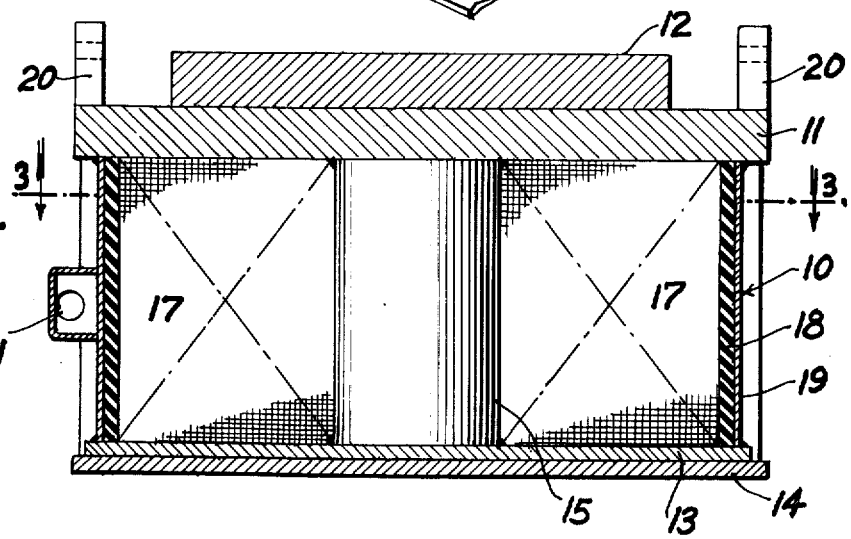
FIG. 2 is a longitudinal cross-sectional view taken on line 2—2 of FIG. 3.
Figure 3:
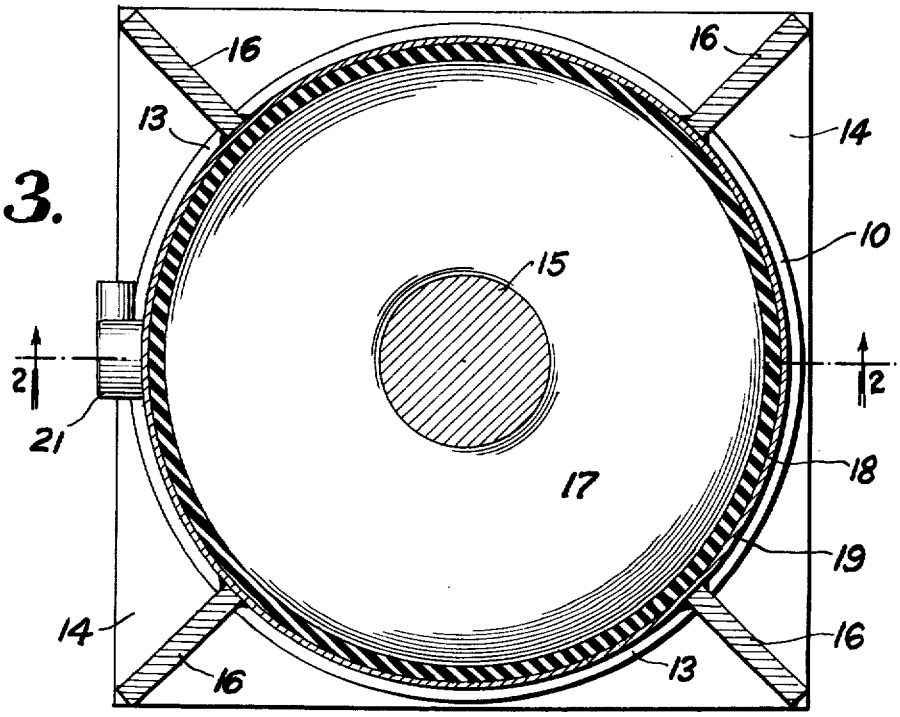
FIG. 3 is a cross-sectional view taken on line 3—3 of FIG. 2.

Now with more particular reference to the drawings, an electromagnet 10 is shown suitable for magnetically removing scrap iron from non-magnetic materials, such as on belts.

The magnet is made up of a steel major back bar 11 that is generally a square plate in configuration and a steel minor back bar 12 supported on the major back bar 11. The circular bottom plate 13 is made of non-magnetic stainless steel and has wear plate 14 fixed to it. Wear plate 14 is disposed in a plane parallel to the bottom plate. Wear plate 14 is likewise made of stainless steel.

Cylindrical core 15 is made of magnetic material and is fixed to the major back bar 11 and extends generally perpendicular thereto. A winding 17 is wound on core 15 and is disposed in the space between the core 15 and the shell 19. The space 18 between the winding and the shell 19 contains an epoxy material filled with grains of high-heat-transfer material. A filled epoxy material contemplated for potting the winding is a material known as "Stycast." This material is an epoxy which is filled with grains of aluminium oxide, tabular, flat, relatively thin platelets having a particle size of 325 grit, about half of said grains being a large size and some of said grains overlapping each other which is an excellent conductor of heat.

The magnet may be supported above a belt 22 by suitable cable or line (not shown), connected to the ears 20. A suitable explosion-proof dust-tight wiring box 21 is fixed to the cylindrical shell 19 which houses the terminals connected to the winding 17. The plate-like corner supports 16 are fixed preferably by welding to the major back bar 11, to the bottom plate 13 and to the cylindrical shell 19, thereby providing a large amount of heat dissipation surface in good heat conductive relation because of the welded parts.

Fins are located at the corners of the electromagnet. These fins not only act as structural members, but also as heat dissipation means exposed to air convection currents for transferring the heat away from the electromagnet. The high heat dissipation capability of the magnet, due to its construction set forth above, makes it possible to build dry electromagnets of substantially larger sizes than are possible to build with conventional heat dissipation techniques commonly used.

The foregoing specification sets forth the invention in its preferred practical forms, but the structure shown is capable of modification within a range of equivalents without departing from the invention which is to be understood is broadly novel as is commensurate with the appended claims.

The embodiments of the invention in which an exclusive property or privilege is claimed are defined as follows:

1. An electromagnet comprising, a back plate, a circular bottom plate and a wear plate supporting said bottom plate, a shell disposed between said back plate and said wear plate and fixed to said back plate, heat dissipation fins disposed between said back plate and said wear plate and adjacent said shell and extending radially outwardly from said shell, a winding disposed in said shell adjacent said back plate, said winding and said shell defining a space therebetween, said space being filled with an epoxy material that is filled with grains of material having a high coefficient of thermalconductivity.

2. The electromagnet recited in claim 1 wherein said epoxy material is filled with tabular grains of material in the form of platelets of 325 grit size and about half the said grains being of a large size, some of said grains overlapping each other.

3. The electromagnet recited in claim 2 wherein said winding is wet wound around said core with said epoxy material, said wet winding then being heat cured to a dry state.

* * * * *